United States Patent [19]

Burns

[11] 4,358,219

[45] Nov. 9, 1982

[54] METHOD FOR CONFINING AN UNCONTROLLED FLOW OF HYDROCARBON LIQUIDS

[75] Inventor: Robert B. Burns, Huntington, N.Y.

[73] Assignee: Texaco Development Corporation, White Plain, N.Y.

[21] Appl. No.: 346,791

[22] Filed: Feb. 8, 1982

[51] Int. Cl.[3] ..... F02B 15/04

[52] U.S. Cl. ..... 405/60; 405/224; 405/195

[58] Field of Search ..... 405/60, 209, 224, 225, 405/226, 203, 204, 53, 195; 210/922, 923

[56] References Cited

U.S. PATENT DOCUMENTS

| | | | |
|---|---|---|---|
| 3,389,559 | 6/1968 | Logan | 405/60 |
| 3,477,236 | 11/1969 | Burrus | 405/204 |
| 3,548,605 | 12/1970 | Paull et al. | 405/60 |
| 3,599,434 | 8/1971 | Missud | 405/60 |
| 3,664,136 | 5/1972 | Laval et al. | 405/60 |
| 3,667,605 | 6/1972 | Zielinski | 405/60 |
| 3,717,001 | 2/1973 | Tam | 405/224 X |
| 3,745,773 | 7/1973 | Cunningham | 405/60 |
| 4,047,390 | 9/1977 | Boyce | 405/60 X |
| 4,169,424 | 10/1979 | Newby et al. | 405/224 X |

*Primary Examiner*—Dennis L. Taylor

*Attorney, Agent, or Firm*—Carl G. Ries; Robert A. Kulason; Robert B. Burns

[57] ABSTRACT

Method for confining and collecting a flow of hydrocarbon fluids which are uncontrollably issuing from a source thereof at the floor of a body of water. A tension leg type floating vessel is positioned above the source of hydrocarbon fluid. An enclosure member is then detached from the vessel and guidably lowered to a location on, or adjacent the ocean floor. Escaping fluids are then received in the enclosure and directed to the water's surface.

7 Claims, 4 Drawing Figures

FIG. 3
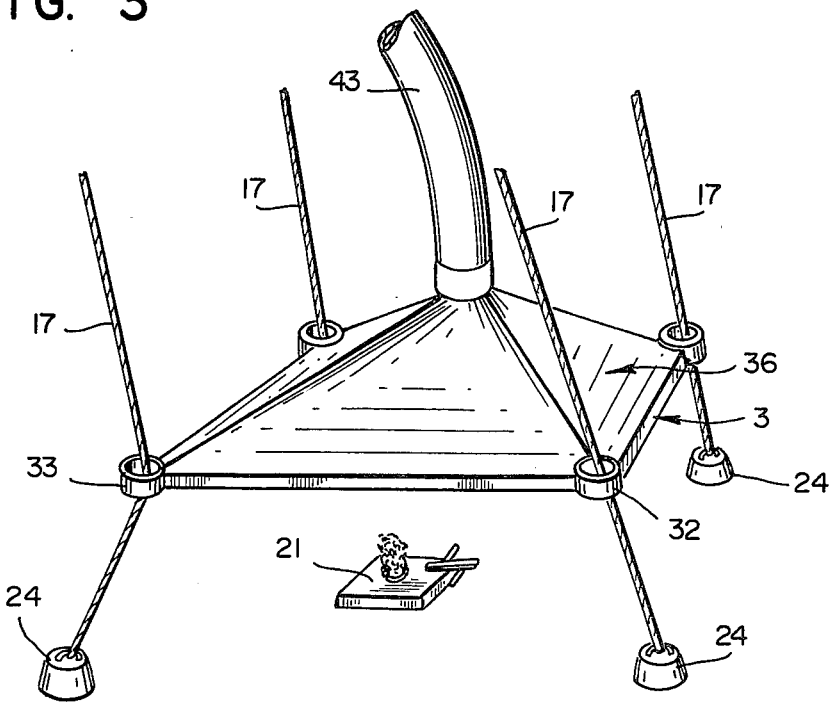
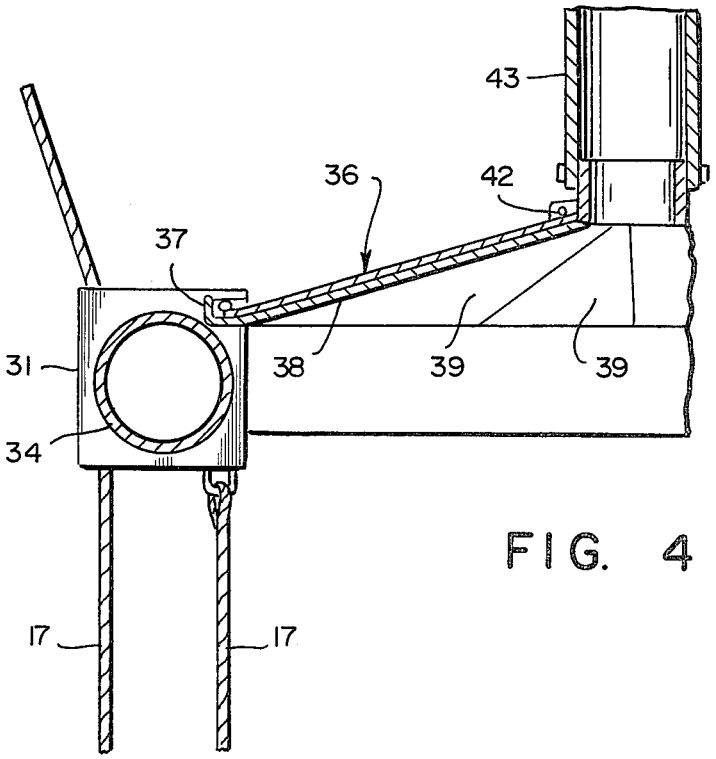
FIG. 4

METHOD FOR CONFINING AN UNCONTROLLED FLOW OF HYDROCARBON LIQUIDS

BACKGROUND OF THE INVENTION

Technological and environmental problems have persistently arisen as the quest for crude oil and gas becomes more and more acute. Further, it has become necessary to go greater distances offshore in search of adequate production areas. However, the further offshore that one goes, the deeper the water will be.

As a consequence, wellbores are being drilled regularly in greater than one thousand feet of water. While much technology is available regarding the safe and controlled drilling of offshore wells, the problems which arise in conjunction with the deeper waters are becoming increasingly complex.

With the greater depths of water in which it becomes necessary to drill, fixed platforms for producing such wells involves enormous costs. It thus reduces to a question of; is the prospective crude oil-containing reservoir beneath the ocean floor is sufficiently abundant to warrant the use of an expensive, deep water drilling and/or producing platform?

Within the past several years, considerable research and development work has been accomplished toward the production of a usable tension leg platform system. In the latter type unit, the basic component comprises a floatable vessel which is capable of adjusting its buoyancy at the water's surface.

A plurality of anchors which have previously been positioned at the ocean floor, are connected to the buoyant vessel by a plurality of holding or pull down cables. It is thus possible, by adjusting the tension on the respective cables, to position the floating vessel above a desired area such as where a well is to be drilled.

The floating vessel will usually be displaced from directly above a drilling site by surface conditions such as wind and waves, as well as by underwater currents. It is nonetheless possible through the use of supported risers or the like, to accomplish drilling operations at great water depths through this type of platform.

A problem which is always present when operating in deep offshore waters, is the possibility that the well or wells being drilled can at any time, become uncontrolled or blown out and flow without restraint. This situation has occurred in the past and frequently results in loss of equipment due to damage and/or fire. It also results in the loss of the crude product and the gas, both of which flow rapidly to the water's surface.

With the added risk involved in drilling wells in deep waters, it is conceivable that even a minor leak or equipment failure at the ocean floor, would permit an uncontrolled and disastrous flow of oil and gas. Such a situation would not only result in the loss of the gas and crude oil, but could constitute a safety hazard to the immediate environment.

To overcome the above-identified problems and difficulties which are endemic to drilling in deep offshore waters, the present invention is provided. In the latter, a method is practiced wherein a marine vessel having a floatable, submergible hull is positioned at the water's surface above a well site, or from another source of an uncontrolled hydrocarbon fluid flow. Hold down, variable tension cables operably connect to the vessel and extend downwardly to the ocean floor. At the latter the cables are connected to a plurality of anchors which are prepositioned about, and spaced from the source of flow.

The submergible hull is provided with a tent-like closure member such that, upwardly flowing and expanding fluids can be received, and conducted in a controlled manner to the water's surface.

The hull is thus operably connected to the respective hold down cables, and guidably lowered toward the ocean floor to be positioned in a manner to collect the fluid flow.

It is therefore an object of the invention to provide a method for effectively confining the hydrocarbon effluent from an uncontrollably flowing offshore well. A further object is to provide a tension leg platform system having means to control and collect the freely flowing effluent from an uncontrolled well at the ocean floor. A still further object is to provide a method for situating a tension leg platform system having a detachably positioned submergible portion, such that the latter can be controllably lowered to the ocean floor by way of the platform's hold down cables.

DESCRIPTION OF THE DRAWINGS

FIG. 3 is a segmentary view showing the canopy in place above a well.

FIG. 4 is an enlarged segmentary view of a canopy unit.

Figure 1:
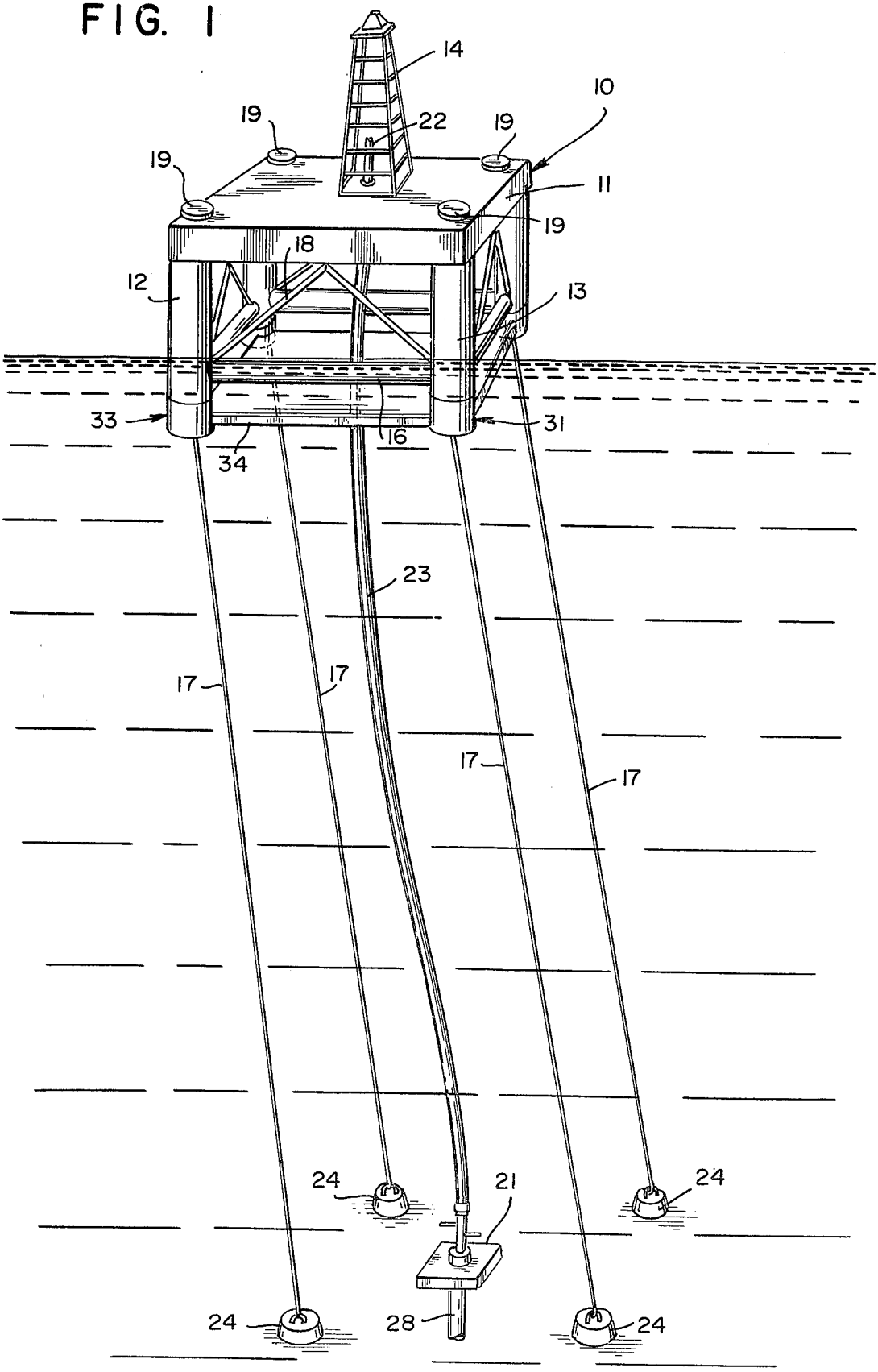
FIG. 1 illustrates a system of the type contemplated in which a marine vessel is positioned by a series of downwardly extending cables.
Figure 2:
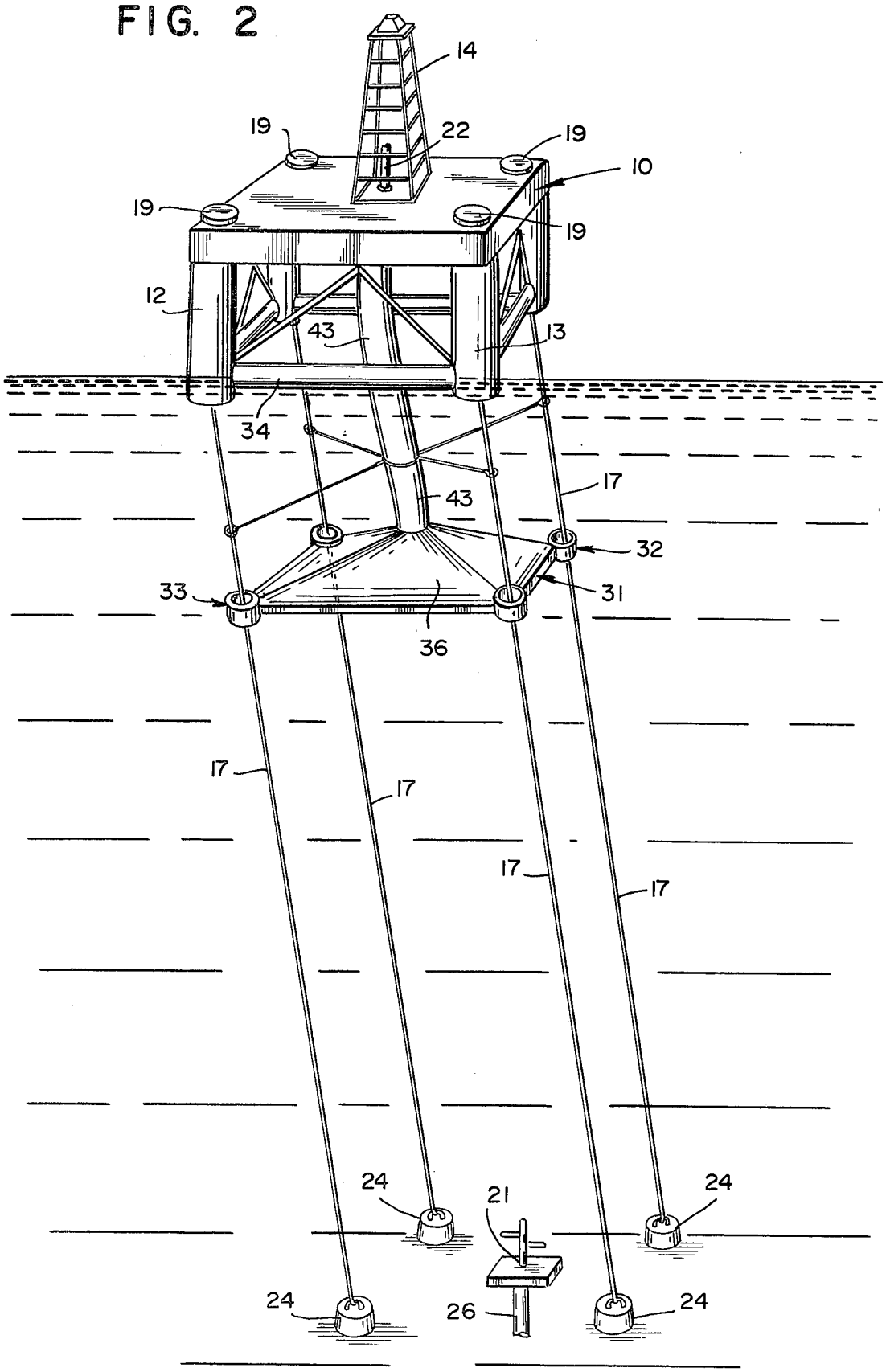
FIG. 2 is similar to FIG. 1, showing an effluent collecting canopy being lowered to the ocean floor.

Referring to the drawings, the present system is shown as embodying a tension leg marine vessel or platform 10 which is comprised of a deck 11 from which a plurality of support legs 12 and 13 downwardly depend. It is understood that the floating, or tension leg vessel is but one, albeit necessary element in the overall system for practicing the method. A single or multi-hull drilling vessel which utilizes the tension leg principle, can be adapted to the present system and method thereof so long as it employs means to engage the respective tension cables which maintain it in position above a drilling site.

Referring to FIG. 1, vessel 10 is comprised primarily of raised deck 11. The latter supports the necessary equipment for achieving a drilling operation. Such equipment normally would be in the form of a derrick 14, together with the usual drilling pipe storage areas, as well as means to accommodate operating personnel.

Deck 11 is preferably positioned a desired distance above the water's surface normally fifty or more feet to maintain the drilling equipment out of the reach of waves, ocean spray and the like. Thus, each platform 10 is provided as shown with a plurality of legs 12 and 13, which are judiciously disposed beneath deck 11 in a manner that they will furnish the necessary buoyancy support.

Each support leg, or controlled buoyancy float 12 and 13, is comprised essentially of an elongated cylindrical member which embodies internal buoyancy tanks. Such internal buoyancy systems including tanks, pumps, piping and the like are well known in the offshore and marine industries and need no further elaboration with respect to the present invention. The respective tanks are in turn connected to pumping means located on deck 11 such that the buoyancy of the entire unit can be regulated and the deck levelled.

Cross members 16 interconnect the various legs and are further equipped with tanks to regulate the buoyancy factor.

Thus, depending on the conditions under which platform 10 is operating, the buoyancy can be adjusted through operation of the platform's internal buoyancy control system. For example, when the platform is traveling between working sites, it normally floats under maximum buoyancy conditions at the water's surface. However, when it is located at a drill site the platform will be buoyed to some extent; it will however be pulled down into the water counter to the buoyant force by the various hold down cables 17.

To provide for lateral strength, the various support legs 12 and 13 can be provided with non-buoyant members 18 in a sufficient number to maintain the rigidity of the various legs with respect to deck 11.

A necessary characteristic of this type platform is the power winches 19 which accommodate the various hold down cables 17. Said winches 19 in the present instance are disposed adjacent to the respective support legs 12 and 13. The winches are provided in sufficient number to assure that vessel 10 can be maintained at a desired disposition regardless of the condition of the weather at the water's surface.

The primary function of vessel 10 is to be held in position over a desired site at the ocean floor. Thus, where the vessel is engaged in a drilling operation, and as herein shown, a well 26 and well head 21 are illustrated which embodies the usual blowout preventers and control equipment. Such well heads 21 are normally provided for offshore, underwater drilling operations.

In order that drill string 22 might be lowered from derrick 14 to well head 21 to achieve the desired drilling, a riser 23 is provided. The latter extends from deck 11, downward through the water, being attached to the well head 21. Thus, drill string 22, together with its flow of drilling mud, can be directed through riser 23 and into the substrate. The mud is then circulated back up through the riser and to a mud tank on deck 11.

Riser 23 normally comprises relatively heavy walled tubing which is of sufficient diameter to freely accommodate the rotating drill string 22 therein. Further, riser 23 is preferably segmented such that it can be assembled at the drill site.

Each support leg or controlled buoyancy float 12 and 13, is provided with at least one hold down cable assembly 17 which extends from the cable winching equipment 19 on deck 11, downward to an anchor element 24. Basically, each cable 17 is connected to said anchor 24 in such manner that when tension is applied to the respective cables through cable winching mechanism 19, the respective cables will be pulled uniformly tighter and thereby lower vessel 10 at a uniform rate and in a horizontal disposition.

As vessel 10 pulled progressively downward into the water, overcoming its own buoyancy by virtue of the tensioned hold down cables, the vessel will become more closely aligned with well head 21 at the ocean floor. However, and as illustrated in the Figures, at greater water depths it is virtually impossible to have the vessel in perfect vertical alignment with well head 21. Ocean currents, and the conditions at the water's surface will usually displace vessel 10 and prohibit accurate alignment.

The respective hold down cable assemblies 17, are here illustrated as being a single cable. Said cable, however, can be in the form of a plurality of cables which extend from each anchor and upward to a pulley system at deck 11. In a similar manner, a pulley assembly can be provided at anchor elements 24 thereby providing the winch mechanism 19 with greater pulling capability.

Operationally, and as herein noted, marine vessel 10 is normally floated to a predetermined offshore drilling site or to an uncontrolled leak site, either by towing or under its own power. In the latter instance, the vessel will be provided with propulsion units positioned at one or more of the various legs or buoyancy floats 12 and 13.

At the desired operating site, anchor elements 24 which have been, or will be positioned at the ocean floor, are disposed in such manner as to align approximately with the various platform support legs. It is appreciated that such alignment may be inaccurate to a degree with respect to the support legs 12 and 13; however, the pull down function of cables 17 will nonetheless be effective so long as tension can be applied uniformly to the various cables.

With platform 10 approximately positioned over a site which has become the subject of an uncontrolled flow, buoyancy of the respective support legs is adjusted such that the platform will float relatively high in the water. Thereafter, tension is applied to each of the hold down cable assemblies 17. The platform will thus gradually be pulled downward into the water. Further, it will be concurrently adjusted more to a position vertically above the various anchors 24 and consequently be located above the desired site.

In the instance of a drilling platform, well head equipment 21 will be installed; likewise riser 23 will be connected between well head 21 and platform 10 to receive a lowering drill string 22. The procedure herein described is standard for tension leg type platforms and will permit the lowering drill string 22 to be guided to the ocean floor and form wellbore 26.

In accordance with the present method, platform 10 and cables 17 are arranged to cooperatively function with submergible hull 31. The latter is comprised primarily of a plurality of corner members 32 and 33, each of which is further provided with internal, controlled buoyancy tanks. The hull therefore constitutes a floatable vessel independent from vessel 10, whose disposition in the water can be controlled from the water's surface.

Submergible hull 31 in one embodiment, is provided with means to detachably connect, to the underside of the respective vertical support legs or float members 12 and 13. It is not only buoyancy controllable, but it is provided with its own buoyancy system. Normally, buoyancy is achieved by the expediency of flexible hoses which attach to compressors and pumps on vessel 10. It is thereby possible to regulate the underwater disposition of submergible hull 31 remotely from the platform 10.

The basic corner members 32 and 33 of submergible hull 31 are connected through a series of welded structural elements 34 in the form of interconnecting tubular sections. The latter thus define a central, vertical well or passage through hull 31. Elements 34 can likewise be provided with internal buoyancy tanks such that they too can be controlled to regulate the disposition of hull 31 in the water.

As shown in FIG. 4, submergible hull 31 is provided with means for receiving a canopy 36 which can be positioned to substantially cover the central opening defined by the hull's peripherally arranged structural members. Said canopy support structure in one embodiment is comprised of a ledge 37 formed on member 34, whereby the segmented canopy can be supported on a canopy superstructure 38.

The respective canopy segments 39 are formed of relatively heavy metal and are further supported by upper and lower pinned joints on superstructure 38 such that adjacent segment members are mutually connected and sealed one to the other. They thus provide a desired fluid tight closure across the central opening of hull 31.

Canopy superstructure 38 includes an upper ring 41. The latter supports and retains the segments' upper ends at pinned or similar connection 42.

To assure the fluid tightness of canopy 36 when in position, the latter can be provided with a flexible liner of reinforced rubber or the like disposed about the inner side thereof. Alternately canopy 36 can be provided with a series of sealing strips which extend along the adjacent edges of the canopy segments 39 and which seals are compressed into water tight connections when the canopy segments are assembled.

When not in use, and as shown in FIG. 1, submergible hull 31 is positioned at the underside of a tension leg platform 10 without the canopy 36 in place. However, at such times as it becomes necessary to utilize the hull to collect escaping hydrocarbon from a well or floor fissure, the respective canopy segments 39 can be quickly positioned on the submergible hull 31, being supported and pinned at the lower and upper edges thereof.

Canopy 36 as shown, is formed in one embodiment of relatively flat members which, when cooperatively positioned, define a closed funnel-like arrangement. However, canopy 36 can likewise be formed of curved segments whereby to form a substantially spherical arrangement. In either instance the upper end of the canopy is provided with an opening at ring 41 into which the effluent from the freely flowing well 26 is received. Said opening is formed with means to engage conduit 43 whether the latter be rigid or of flexible construction.

In the instance of a rigid conduit 43, the latter is of relatively wide diameter to receive not only the upwardly flowing crude oil but also the gases which have been released, and which will expand in the water to bubble and cause turbulence if not confined.

Operationally, in the present arrangement the tension leg platform 10 will, as herein noted, achieve its drilling function by way of riser 23 and well head 21. Where the uncontrolled hydrocarbon fluid flow is not from a well, vessel 10 will nonetheless function in a like manner.

In the event well 26 becomes uncontrollable due to excessive pressure, a breakdown of equipment, or for any other reason, the riser will be detached from the well head and retrieved onto the platform 10.

Thereafter, the platform's buoyancy is adjusted to raise it higher in the water such that the canopy segments 39 can be positioned on submergible hull 31. Preferably this assembly operation is achieved above the water. However, depending on the weight of platform 10, the submergible hull 31 might be disposed underwater with the necessity that the canopy members be installed at least partially by divers.

In any event, with hull 31 equipped with canopy 36, the lower end of conduit 23 is attached to the canopy upper opening at 41. The submergible hull is now slidably engaged with the respective hold down cables 17.

Although submergible hull 31 is provided with controlled buoyancy tanks, the hull is preferably lowered to the ocean floor by a cable pull down system. The latter is comprised of a separate pull down cable which is integral with cable 17, and which is connected at one end to submergible hull 31. It extends downwardly through positioning anchor 24, and thence through a pulley arrangement 44. The pull down cable is then led upwardly through corner member 33 of hull 31 to winch 19 on platform 10.

Thus, in spite of the turbulence which is created at the water's surface, as well as in the water by rapidly rising and expanding gas bubbles, the entire submergible hull 31 can be forcibly drawn downward. This is achieved by uniformly tensioning and in-reeling all the pull down cables 17 concurrently such that the hull will be maintained in a relatively vertical disposition. This disposition will be sustained despite its buoyed tendency, and thereby avoid the possibility of becoming tilted in a manner to bind on one or more of the hold down cables.

As the hull 31 is progressively pulled toward the ocean floor, conduit 43 will be extended such that its upper end will be at the water's surface.

Where a non-rigid conduit 43 is utilized, the latter in one embodiment can be comprised of an elongated member which is sufficiently flexible to be compressed about opening 41 at the canopy top. Thereafter, as the hull is lowered, the conduit 43 can be drawn from its compressed condition with the upper opening being retained at the surface and connected to separating equipment which will receive the fluidized effluent from the uncontrolled source thereof.

As submergible hull 31 approaches well head 21 from above, more and more of the rising effluent will be trapped, received therein, and conducted to the water's surface. Thus, it may not be necessary for the hull 31 to be brought all the way to the ocean floor. It can in some instances be suspended a distance above well 26, or above the freely flowing effluent source such that the latter will rise into the closure area beneath the canopy. The rising gas and oil will then pass as noted upward through conduit 43 to the separating equipment at the water's surface.

As herein mentioned, the waters adjacent to and above well 26 will be in a state of turbulence due to expanding gas. In like manner, upwardly flowing fluid within the conduit will experience the internal effects of expanding gases as well as external water pressure. To stabilize conduit 43, the latter can be provided at vertical intervals with a series of vertically spaced arms which are braced against cables 17 for support.

While the freely flowing hydrocarbons are thus being collected and retained, necessary steps can be taken to either plug well 26 or to in other ways regulate the uncontrolled flowing by a diversion well or other means. In any event, submergible hull 31 will be retained in place until such time as the uncontrolled flow has been stemmed. Thereafter, the hull can be raised from its ocean floor position by the respective pull down cables 17 and by its own buoyancy.

At the water's surface, canopy segments 39 will be removed from hull 31 and vessel 10 will again be in condition to commence a new drilling operation, or to be removed.

Other modifications and variations of the invention as hereinbefore set forth can be made without departing from the spirit and scope thereof, and therefore, only such limitations should be imposed as are indicated in the appended claims.

I claim:

1. Method for confining an uncontrolled outflowing stream of hydrocarbon fluids from a source thereof at the floor of a body of water, which method comprises the steps of;

positioning a floating vessel at the water's surface above said source of hydrocarbon fluids, said vessel comprising a hull, a plurality of controlled buoyant floats which depend downwardly from the hull to support the latter beyond the water's surface, and a controlled buoyancy raft releasably connected to the respective floats, locating a plurality of anchor members at the ocean floor, being spaced about said hydrocarbon fluid source, each of said anchor members including a tension line which extends to the vessel and is adjustable to draw said vessel downward against the buoyant action of said buoyant floats whereby to substantially align the floating vessel above the hydrocarbon fluid source, applying a tent element to said raft to define a fluid confining enclosure thereon, and guidably lowering the raft along the respective anchor member tension lines, whereby said tent element will be disposed above said hydrocarbon fluid source in position to receive said uncontrolled outflowing stream of hydrocarbon fluids.

2. Method as defined in claim 1, including the step of; extending a conduit from said tent element to the surface of the water whereby to conduct said stream of hydrocarbon fluids which issues from the source, to the water's surface.

3. Method as defined in claim 1, including the step of; lowering said raft to position the latter in contact with the ocean floor whereby to enclose said hydrocarbon fluid stream with said tent element.

4. Method as defined in claim 1, including the step of; applying a downward pull on said raft to overcome the buoyant affect thereof as the raft is drawn to the ocean floor.

5. Method as defined in claim 1, including the step of adjusting the buoyancy of said raft to provide a positive buoyancy.

6. Method as defined in claim 1, including the step of; prepositioning said plurality of anchor members at the ocean floor in a pattern conforming substantially to the configuration of said raft.

7. Method as defined in claim 1, wherein said anchor members are prepositioned at the ocean floor by removably engaging the respective anchor members to the underside of said raft, thereafter lowering the engaged raft and anchor members to the ocean floor, and detaching the raft from the respective anchor members and raising said raft to the water's surface.

* * * * *